US008602037B2

(12) United States Patent
Inagaki

(10) Patent No.: US 8,602,037 B2
(45) Date of Patent: Dec. 10, 2013

(54) SMOKING ARTICLE

(75) Inventor: Michihiro Inagaki, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 246 days.

(21) Appl. No.: 12/580,117

(22) Filed: Oct. 15, 2009

(65) Prior Publication Data

US 2010/0031967 A1 Feb. 11, 2010

Related U.S. Application Data

(63) Continuation of application No. PCT/JP2008/057295, filed on Apr. 14, 2008.

(30) Foreign Application Priority Data

Apr. 18, 2007 (JP) ..... 2007-109459

(51) Int. Cl.
*A24B 1/00* (2006.01)
*A24F 5/04* (2006.01)

(52) U.S. Cl.
USPC ..... 131/360; 131/338; 131/330; 131/187; 131/198.1; 131/198.2

(58) Field of Classification Search
USPC ..... 131/360, 338, 908, 330, 187, 198.1, 131/198.2
See application file for complete search history.

(56) References Cited

U.S. PATENT DOCUMENTS

| | | | | |
|---|---|---|---|---|
| 3,476,119 | A * | 11/1969 | Walton | 131/330 |
| 4,019,366 | A * | 4/1977 | Claflin et al. | 73/23.3 |
| 4,246,913 | A | 1/1981 | Ogden et al. | |
| 4,771,381 | A * | 9/1988 | Norman et al. | 705/10 |
| 4,947,874 | A | 8/1990 | Brooks et al. | |
| 5,044,380 | A * | 9/1991 | Crooks et al. | 131/329 |
| 5,372,148 | A | 12/1994 | McCafferty et al. | |
| 7,100,420 | B2 * | 9/2006 | Read et al. | 73/23.33 |
| 2004/0031497 | A1 | 2/2004 | Likness et al. | |
| 2004/0177674 | A1 | 9/2004 | Read et al. | |
| 2006/0099554 | A1 | 5/2006 | Frost | |
| 2006/0130860 | A1 | 6/2006 | Cholet | |

FOREIGN PATENT DOCUMENTS

| | | | |
|---|---|---|---|
| CA | 2 647 212 | A1 | 11/2007 |
| CH | 636757 | A5 | 6/1983 |
| CN | 1045691 | A | 10/1990 |
| CN | 2482810 | Y | 3/2002 |
| CN | 2501324 | Y | 7/2002 |
| CN | 1719989 | A | 1/2006 |
| EP | 0358002 | A2 | 3/1990 |
| JP | 2-124082 | A | 5/1990 |
| JP | 7506008 | A | 7/1995 |
| JP | 2004-532045 | A | 10/2004 |
| JP | 3696619 | B1 | 9/2005 |
| JP | 2006-507499 | A | 3/2006 |
| WO | WO 88/06836 | A2 | 9/1988 |
| WO | WO 94/18860 | A1 | 9/1994 |
| WO | WO 95/01137 | A1 | 1/1995 |
| WO | WO 02/098245 | A1 | 12/2002 |
| WO | WO 2004/047570 | A2 | 6/2004 |

* cited by examiner

*Primary Examiner* — Richard Crispino
*Assistant Examiner* — Dionne Walls Mayes
(74) *Attorney, Agent, or Firm* — Birch, Stewart, Kolasch & Birch, LLP

(57) ABSTRACT

A smoking article includes a monitor monitoring a smoke delivery from a cigarette or a physical quantity correlated with the smoke delivery, a regulating mechanism regulating the smoke delivery, and a control unit controlling the regulating mechanism depending on the smoke delivery.

5 Claims, 2 Drawing Sheets

SMOKING ARTICLE

CROSS REFERENCE TO RELATED APPLICATIONS

This is a Continuation Application of PCT Application No. PCT/JP2008/057295, filed Apr. 14, 2008, which was published under PCT Article 21(2) in Japanese.

This application is based upon and claims the benefit of priority from prior Japanese Patent Application No. 2007-109459, filed Apr. 18, 2007, the entire contents of which are incorporated herein by reference.

BACKGROUND OF THE INVENTION

1. Field of the Invention

The present invention relates to a smoking article which controls variations in a smoke delivery caused by a difference in smoking behavior.

2. Description of the Related Art

Cigarettes commercially available in Japan have the contents of tar and nicotine displayed on their packages. These values are delivered values when the cigarettes are smoked through a smoking article under ISO conditions. It is known that the values displayed on cigarette packages may not be achieved depending on the individual smoking behavior.

A device for monitoring individual smoking behavior or the smoke delivery is described in, for example, U.S. Patent Application Publication No. 2006/0099554, U.S. Patent Application Publication No. 2006/0130860 and U.S. Pat. No. 7,100,420. However, these devices are simply intended to monitor the smoke delivery, and cannot control variations in the smoke delivery caused by the difference in individual smoking behavior.

BRIEF SUMMARY OF THE INVENTION

An object of the present invention is to provide a smoking article which controls variations in the smoke delivery caused by the difference in individual smoking behavior.

A smoking article according to one aspect of the present invention comprising: a monitor monitoring a smoke delivery from a cigarette or a physical quantity correlated with the smoke delivery; a regulating mechanism regulating the smoke delivery; and a control unit controlling the regulating mechanism depending on the smoke delivery.

According to the present invention, there is provided a smoking article which controls variations in the smoke delivery caused by the difference in individual smoking behavior.

DETAILED DESCRIPTION OF THE INVENTION

The smoking article of the present invention has a cigarette holder, on which a commercially available cigarette can easily be mounted.

The monitor monitors the smoke delivery from a cigarette or a physical quantity correlated with the smoke delivery in real time. For example, the monitor may be a negative pressure gauge for measuring a negative pressure of a cigarette during smoking correlated with the smoke delivery, a flowmeter for measuring a flow rate in a smoke path correlated with the smoke delivery, or a photoreceiver for measuring a smoke density in a smoke path correlated with the smoke delivery.

The control unit converts the physical quantity correlated with the smoke delivery to the smoke delivery. More specifically, the control unit converts the negative pressure to the puff volume, and the puff volume to the smoke delivery. The control unit also converts the flow rate to the smoke delivery, and converts the smoke density to the smoke delivery.

The regulating mechanism regulates the smoke delivery in real time, and may be a mechanism for regulating an input of dilution air into the smoke path, or a mechanism for regulating the draw resistance in the smoke path.

In the present invention, the method for controlling the smoke delivery is not particularly limited. For example, the smoke delivery per puff is monitored, and the smoke delivery is stopped when the total smoke delivery reaches a predetermined value.

Alternatively, the smoke delivery per puff is monitored, and the smoke delivery is stopped when the smoke delivery by one puff reaches a predetermined value. Further, the smoke delivery may be finely adjusted.

The present invention will be described below in more detail based on Examples.

Example 1

Figure 1:
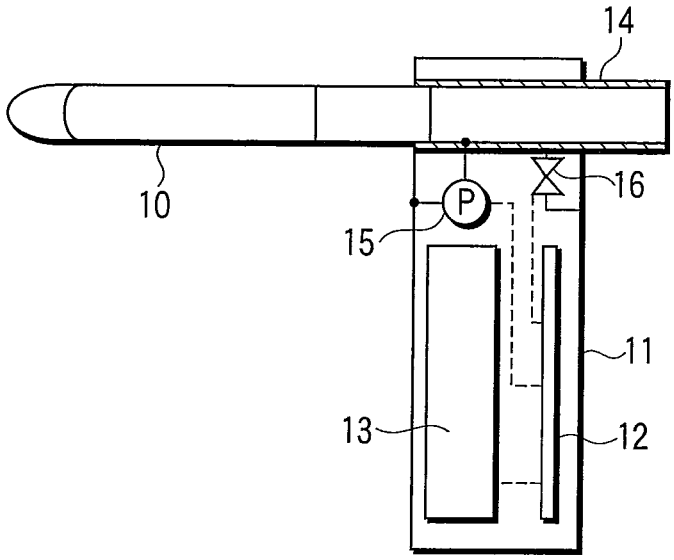
FIG. 1 is a schematic view showing the structure of a smoking article according to Example 1.

FIG. 1 is a schematic view showing the structure of a smoking article according to Example 1. A smoking article body 11 includes a control board 12, and provided with a battery 13 as a power source. A mouthpiece 14 is attached to the upper portion of the smoking article body 11. A cigarette 10 is mounted on the tip of the mouthpiece 14. The smoking article body 11 includes a differential pressure sensor 15 for measuring the differential pressure between the smoke path in the mouthpiece 14 and the outer space. The smoking article body 11 further includes a stop valve 16 for closing or opening between the smoke path in the mouthpiece 14 and the outer space.

There is positive correlation between the negative pressure and the puff volume of a cigarette, and between the puff volume and the smoke delivery. Therefore, the negative pressure of a cigarette measured by the differential pressure sensor 15 is converted by the control board 12 to the smoke delivery according to the above correlation formula, whereby the smoke delivery can be monitored in real time. In the smoking article in this Example, the stop valve 16 is opened when a predetermined smoke delivery is reached. As a result, no smoke is delivered by excess puff, but only dilution air is introduced. Accordingly, the smoke delivery as displayed on the package is ensured irrespective of smoking behavior.

It should be noted that different cigarettes have different correlations between the negative pressure and the puff volume, and between the puff volume and the smoke delivery. Therefore, an appropriate correlation coefficient is given to the cigarette to be smoked. In order to achieve this, the following approaches are suggested. For example, a user inputs or selects the type of a cigarette, thereby giving an appropriate correlation coefficient. Alternatively, information about a cigarette is displayed on its package in the form of bar code, and the bar code is read by a bar code reader attached to the smoking article, thereby giving an appropriate correlation coefficient. Alternatively, a chip storing the correlation coefficient for a cigarette is embedded in the cigarette, and the information is automatically read from the chip when the cigarette is mounted on the smoking article, thereby giving the appropriate correlation coefficient.

The method for controlling the smoke delivery is not particularly limited. For example, the smoke delivery per puff is monitored, and the stop valve 16 is fully opened to stop the smoke delivery when the total smoke delivery reaches a predetermined value. Alternatively, the smoke delivery per puff is monitored, and the stop valve 16 is fully opened to stop the smoke delivery when the smoke delivery by one puff reaches a predetermined value.

In FIG. 1, the differential pressure sensor 15 and the stop valve 16 each have their one end exposed to the outer space at atmospheric pressure. It is preferable that these members do not lose their function even if the exposed ends are blocked with a user's finger or the like, or that the exposed ends are protected from blockage. This is readily achieved by arranging a groove such that the exposed ends will not be completely blocked with a finger or the like, or by arranging the exposed ends at positions such that they will not be blocked with a finger or the like during use.

Example 2

Figure 2:
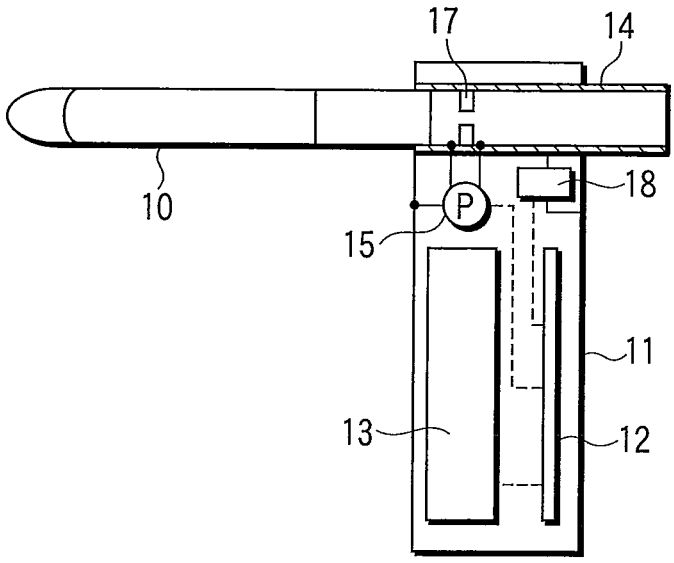
FIG. 2 is a schematic view showing the structure of a smoking article according to Example 2.

FIG. 2 is a schematic view showing the structure of a smoking article according to Example 2. Descriptions for the same members as those in FIG. 1 are omitted. In FIG. 2, an orifice 17 is provided in the smoke path within a mouthpiece 14. The smoking article body 11 is provided with a differential pressure sensor 15 for measuring the differential pressure between the upstream and downstream of the orifice 17. The smoking article body 11 is also provided with a flow control valve 18 for allowing the smoke path within the mouthpiece 14 to communicate with the outer space. The flow control valve 18 regulates the path area with a solenoid actuator or the like, thereby regulating the flow rate of dilution air.

The differential pressure between the upstream and downstream of the orifice 17 is positively correlated with the puff volume irrespective of the type of a cigarette. Therefore, the puff volume can be monitored in real time by measuring the negative pressure using the differential pressure sensor 15. There is a positive correlation between the puff volume and the smoke delivery, but the correlation formula varies with the type of the cigarette. Therefore, a mechanism for giving information about the type of the cigarette or an appropriate correlation coefficient of the cigarette is provided in the same manner as in Example 1.

In this Example, the flow rate of dilution air may be finely adjusted by the flow control valve 18, whereby the smoke delivery as displayed on the package is ensured irrespective of smoking behavior.

Example 3

Figure 3:
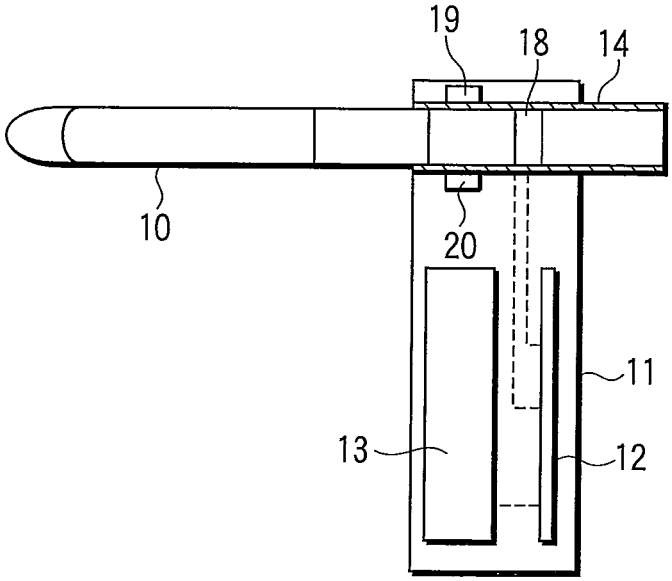
FIG. 3 is a schematic view showing the structure of a smoking article according to Example 3.

FIG. 3 is a schematic view showing the structure of a smoking article according to Example 3. Descriptions for the same members as those in FIG. 1 are omitted. In FIG. 3, a smoke path within a mouthpiece 14 is sandwiched between a light source 19 and a photoreceiver 20 arranged opposed to each other. In this case, the mouthpiece 14 transmits light. A flow control valve 18 is provided in the smoke path downstream from the light source 19 and the photoreceiver 20. The flow control valve 18 regulates the path area with a solenoid actuator or the like, thereby regulating the draw resistance in the smoke path to adjust the smoke delivery.

The amount of light received by the photoreceiver 20 decreases with the smoke density, and thus is negatively correlated with the smoke delivery. In this case, the smoke delivery can be monitored in real time irrespective of the type of the cigarette.

In this Example, the draw resistance in the smoke path can be finely adjusted by the flow control valve 18, whereby the smoke delivery as displayed on the package is ensured irrespective of smoking behavior.

What is claimed is:

1. A smoking article comprising:

a mouthpiece into which an end of a cigarette is inserted;

a monitor monitoring a physical quantity correlated with a smoke delivery from the cigarette;

a valve arranged between a smoke path in the mouthpiece and an outer space and configured to regulate an input of dilution air into the smoke path in the mouthpiece in order to regulate the smoke delivery; and a control unit controlling the valve depending on the physical quantity correlated with the smoke delivery monitored by the monitor.

2. The smoking article according to claim 1, wherein the monitor is a negative pressure gauge which measures a negative pressure in the smoke path in the mouthpiece during smoking as the physical quantity correlated with the smoke delivery.

3. The smoking article according to claim 1, wherein the monitor is a flowmeter which measures a flow rate in the smoke path in the mouthpiece as the physical quantity correlated with the smoke delivery.

4. The smoking article according to claim 1, wherein the monitor is a photoreceiver which measures a smoke density in the smoke path in the mouthpiece during smoking as the physical quantity correlated with the smoke delivery.

5. The smoking article according to claim 1, wherein the control unit is configured to convert the physical quantity correlated with the smoke delivery to the smoke delivery.

* * * * *